United States Patent [19]

Iiyama et al.

[11] Patent Number: 4,665,410

[45] Date of Patent: May 12, 1987

[54] MULTI-COLOR THERMOSENSITIVE RECORDING MATERIAL

[75] Inventors: Kiyotaka Iiyama, Mishima; Norihiko Inaba, Numazu, both of Japan

[73] Assignee: Ricoh Company, Ltd., Tokyo, Japan

[21] Appl. No.: 853,625

[22] Filed: Apr. 18, 1986

[30] Foreign Application Priority Data

Apr. 20, 1985 [JP] Japan ..... 60-84944

[51] Int. Cl.[4] ..... B41M 5/18

[52] U.S. Cl. ..... 346/204; 346/201; 346/205; 346/226; 427/152

[58] Field of Search ..... 346/200, 204, 205, 206, 346/226, 201, 218, 219, 222, 221; 427/150, 151, 152

[56] References Cited

U.S. PATENT DOCUMENTS 4,020,232 4/1977 Kohmura et al. ..... 346/205
4,125,636 11/1978 Kamio et al. ..... 346/205
4,172,727 10/1979 Miyamoto et al. ..... 346/205

FOREIGN PATENT DOCUMENTS 0047843 4/1978 Japan ..... 346/204
0040588 4/1981 Japan ..... 346/204
0054597 3/1984 Japan ..... 346/204
0068991 4/1985 Japan ..... 346/204

*Primary Examiner*—Bruce H. Hess
*Attorney, Agent, or Firm*—Oblon, Fisher, Spivak, McClelland & Maier

[57] ABSTRACT

A multi-color thermosensitive recording material comprising a support material, three or more thermosensitive coloring layer successively overlaid thereon and decolorizing intermediate layers interposed between the thermosensitive coloring layers, with at least the thermosensitive coloring layers except the thermosensitive coloring layer adjacent to the support material each comprising a basic leuco dye and a color developer capable of inducing color formation in the leuco dye upon application of thermal energy at a predetermined temperature, and each decolorizing intermediate layer containing a decolorizing agent which is capable of decolorizing the color developed in the thermosensitive coloring layer adjacent to the decolorizing intermediate layer when heated to a higher temperature than the predetermined coloring temperature for the thermosensitive coloring layer, which decolorizing agent for use in at least one of the decolorizing layers is (i) a N,N'-disubstituted aromatic diamide compound, (ii) a piperazine compound having at least two amido groups or (iii) a combination of the two compounds.

17 Claims, No Drawings

MULTI-COLOR THERMOSENSITIVE RECORDING MATERIAL

BACKGROUND OF THE INVENTION

The present invention relates to a multi-color thermosensitive recording material and more particularly to a multi-color thermosensitive recording material comprising a support material and three or more thermosensitive coloring layers successively overlaid thereon, each coloring layer being capable of yielding a different color by application of a different quantity of thermal energy thereto.

A conventional thermosensitive recording material comprises a support material such as a sheet of paper and a thermosensitive coloring layer formed on the support material, in which thermosensitive coloring layer colored images can be formed by application of heat thereto. For heat application for such image formation, a thermal head is in general use. In the thermosensitive coloring layer of such a conventional thermosensitive recording material, a colorless or light-colored leuco dye containing, for instance, a lactone ring, a lactam ring or a spiropyran ring, and a color developer which induces color formation in the leuco dye upon application of heat by the reaction with the leuco dye are usually employed. This is because such coloring system is capable of yielding clear images with minimized fogging.

Because of the capability of forming colored images by simple application of heat, such thermosensitive recording materials are widely used, not only for copying books and documents, but also for recording output information from computers, facsimile apparatus, telex and other information transmission and measuring instruments, and as the materials for making tickets, farecards and bar code labels. Depending upon the recording mode, it will be more convenient if it is allowed to record particular data in a different color from the remainder on the thermosensitive recording material in order to display the particular data more distinctly from the remainder.

Recently, many trials have been made to attain recording with multiple colors by applying heat at different temperatures or by applying different quantities of thermal energy. Accordingly, a variety of multi-color thermosensitive recording sheets have been proposed.

A conventional multi-color thermosensitive recording sheet comprises a support material and two thermosensitive color-forming layers formed on the support material, which color-forming layers are colored in different colors upon application of different thermal energies thereto respectively. One layer is referred to as, for example, a high-temperature color-forming layer and the other is referred to as, for example, a low-temperature color-forming layer. The low-temperature color-forming layer forms a color at a low temperature, while the high-temperature color-forming layer does not form a color at all at the low temperature, but forms a color at a high temperature which is higher than the low temperature, and the two colors are different from each other.

Such conventional multi-color thermosensitive recording sheets can be roughly classified into the following two types.

In one type, when a high-temperature color-forming layer is colored by application of heat at a high temperature, the color developed in the high-temperature color-forming layer is mixed with the color which has already been developed in a low-temperature color-forming layer, so that a different color from the color developed in the low-temperature layer is produced in the high-temperature color-forming layer.

In the other type, when the high-temperature color-forming layer is colored, the color developed in the low-temperature color-forming layer is decolorized by a decolorizing agent, so that only the high-temperature color-forming layer is colored without the color of the low-temperature color-forming layer being mixed therewith.

Specific examples of the former type are disclosed, for instance, in Japanese Patent Publications Nos. 49-69, 49-4342 and 49-27708, and Japanese Laid-Open Patent Applications Nos. 48-86543 and 49-65239.

Specific examples of the latter type are disclosed, for instance, in Japanese Patent Publications Nos. 50-17865, 50-17866, 51-29024 and 51-87542.

The former type has the shortcoming that the practically developable color systems are limited to such combinations that the color developed at high temperature can overcome the color developed at low temperature, such as red (low temperature)–black (high temperature), and blue (low temperature)–black (high temperature).

In the latter type, there are no particular limitations to the combination of colors. However, a decolorizing agent capable of completely decolorizing the color developed in the low-temperature coloring color-forming layer (when developing a color in the high temperature color-forming layer) has not been discovered, although higher aliphatic alcohols, polyether, polyethylene glycol derivatives, nitrogen-containing compounds such as acetamide, stearamide, phthalonitrile, and amine derivatives are proposed as such decolorizing agents. In fact the separation of the color in the high temperature color-forming layer from the color in the low temperature color-forming layer is incomplete, so that the color developed in the low temperature color-forming layer spreads and overlaps the color developed in the high temperature color-forming layer. Some of such conventional decolorizing agents have acceptable decolorizing performance, but the melting points are not appropriate for use in practice or the coating stability is so poor that they cannot be securely coated on the paper.

SUMMARY OF THE INVENTION

It is therefore an object of the present invention to provide a multi-color thermosensitive recording material comprising a support material and three or more thermosensitive coloring layers successively overlaid thereon, each coloring layer being capable of yielding a different color by application of a different quantity of thermal energy thereto, with excellent color separation and each color having a high density, not discoloring with time.

According to the present invention, the above object of the present invention is achieved by a multi-color thermosensitive recording material comprising a support material, three or more thermosensitive coloring layers successively overlaid thereon and decolorizing intermediate layers interposed between the thermosensitive coloring layers.

In the present invention, at least the thermosensitive coloring layers except the thermosensitive coloring layer adjacent to the support material each comprise a basic leuco dye and a color developer capable of inducing color formation in the leuco dye upon application of thermal energy at each predetermined temperature, and each decolorizing intermediate layer contains a decolorizing agent which is capable of decolorizing the color developed in the thermosensitive coloring layer adjacent to the decolorizing intermediate layer when heated to a higher temperature than the predetermined coloring temperature for the thermosensitive coloring layer.

The decolorizing agent for use in at least one of the decolorizing layers is (i) a N,N'-disubstituted aromatic diamide compound, (ii) a piperazine compound having at least two amido groups or (iii) a combination of the two compounds.

DETAILED DESCRIPTION OF THE PREFERRED EMBODIMENTS

In the multi-color thermosensitive recording material according to the present invention, three or more thermosensitive coloring layers are successively overlaid on a support material and each coloring layer is capable of yielding a different color by application of a different quantity of thermal energy thereto. Further, decolorizing intermediate layers are interposed between the thermosensitive coloring layers.

More specifically, a 1st thermosensitive coloring layer, a 1st decolorizing layer, a 2nd thermosensitive coloring layer, a 2nd decolorizing layer,..., an (n−1)th thermosensitive coloring layer, an (n−1)th decolorizing layer and an (n)th thermosensitive coloring layer are successively overlaid on a support material.

The magnitudes of thermal energies applied to these thermosensitive coloring layers for color formation, that is, $E_1$ for the 1st thermosensitive coloring layer, $E_2$ for the 2nd thermosensitive coloring layer,..., $E_{n-1}$ for the (n−1)th thermosensitive coloring layer and $E_n$ for the (n)th thermosensitive coloring layer, are in the order of $E_1 > E_2 >, \ldots, E_{n-1} > E_n$.

In the other words, as long as thermal energies are applied to the thermosensitive recording material under the above mentioned conditions with respect to the magnitude of the energy to be applied to each coloring layer, n colors can be obtained with excellent color separation in the multi-color thermosensitive recording material. More specifically, when a thermal energy $E_n$ is applied to the recording material, only the (n)th thermosensitive coloring layer is colored. When a thermal energy $E_{n-1}$ is applied to the recording material, the (n−1)th thermosensitive coloring layer is colored. Since the thermal energy $E_{n-1}$ is larger in quantity than the thermal energy $E_n$, the (n)th thermosensitive coloring layer is also colored. However, when thermal energy $E_{n-1}$ is applied, the (n−1)th decolorizing layer works so as decolorize the color developed in the (n)th thermosensitive coloring layer. The result is that only the color developed in the (n−1)th thermosensitive coloring layer remains in a stable manner.

When thermal energy $E_1$ is applied to the recording material, the colors developed in the (n)th through 2nd thermosensitive coloring layers are all decolorized by the (n−1)th through 1st decolorizing layers, so that the color developed in the 1st thermosensitive coloring layer remains in a stable manner.

When a thermal energy in an amount sufficient for coloring the (n)th thermosensitive coloring layer but insufficient for completely coloring the (n−1)th thermosensitive coloring layer (and therefore by which the (n−1)th layer is partially colored) is applied to the recording material, the (n−1)th decolorizing layer does not sufficiently work upon the (n)th thermosensitive coloring layer, so that a mixed color of the color developed in the (n)th thermosensitive coloring layer and the color developed in the (n−1)th thermosensitive coloring layer is formed. A multi-color thermosensitive coloring layer having n thermosensitive coloring layers is capable of yielding n−1 mixed colors of such type. Since each thermosensitive coloring layer can form its own particular color, the total number of the colors that can be produced by the multi-color thermosensitive coloring layer is 2n−1.

In the present invention, at least one decolorizing layer contains as decolorizing agent a N,N'-disubstituted aromatic diamide compound, a piperazine compound having at least two amide groups, or a combination of the two compounds. In the other decolorizing layers, conventional decolorizing agents used in this field can also be employed. However, it is preferable that the above decolorizing agent be employed in all the decolorizing layers in the present invention, whereby clear-cut multi-colors can be obtained with excellent color separation.

The N,N'-disubstituted aromatic diamide compound has the following formula (I):

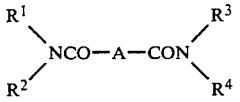

(I)

wherein $R^1$, $R^2$, $R^3$ and $R^4$ each represent an alkyl group, cycloalkyl group, aryl group or aralkyl group which may have a substituent, the combination of $R^1$ and $R^2$ and the combination of $R^3$ and $R^4$ each may form a ring structure with the terminals of the groups in each combination being bonded to each other, and A represents an an aromatic group.

The above alkyl group is preferably a straight chain or branched alkyl group having 1 to 18 carbon atoms (more preferably 4 to 18 carbon atoms). An example of the cycloalkyl group is cyclohexyl group; examples of the aryl group are phenyl group, tolyl group and xylyl group; and examples of the aralkyl group are benzyl group and phenethyl group.

Examples of the substituents of such alkyl group, cycloalkyl group, aryl group or aralkyl group, alkyl group, aryl group, alkoxy group, acyl group, halogen, acylamino group (such as benzoylamino and acetylamino groups), alkoxycarbonyl group, carbamoyl group, aryloxy group and aralkyloxy group.

Examples of the aromatic group represented by A are arylene groups such as unsubstituted or substituted phenylene, tolylene and xylylene, and the substituents thereof are, for example, halogen, acylamino group, alkoxycarbonyl group, carbamoyl, aryoxy group and aralkyloxy group.

Specific examples of the N,N'-disubstituted aromatic diamide compound having the above formula (I) are as follows:

N,N'-terephthaloylbispiperidine,
N,N'-isophthaloylbispiperidine,
N,N'-phthaloylbisperidine,
N,N'-terephthaloylbismorpholine,
N,N'-isophthaloylbismorpholine,
N,N'-phthaloylbismorpholine,
N,N'-terephthaloylbis-4-methylpiperazine, N,N'-isophthaloylbis-4-methylpiperazine,
N,N'-phthaloylbis-4-methylpiperazine,
N,N'-terephthaloylbis-4-phenylpiperazine,
N,N'-isophthaloylbis-4-phenylpiperazine,
N,N'-phthaloylbis-4-phenylpiperazine,
N,N'-terephthaloylbis-4-propylpiperazine,
N,N'-isophthaloylbis-4-propylpiperazine,
N,N'-phthaloyl-4-propylpiperazine,
N,N'-terephthaloylbiscaprolactam,
N,N'-isophthaloylbiscaprolactam,
N,N'-phthaloylbiscaprolactam,
N,N'-terephthaloylbis-3-chlorocaprolactam,
N,N'-isophthaloylbis-3-chlorocaprolactam,
N,N'-phthaloylbis-3-chlorocaprolactam,
N,N'-terephthaloylbisvalerolactam,
N,N'-isophthaloylbisvalerolactam,
N,N'-phthaloylbisvalerolactam,
N,N'-terephthaloylbispyrrolidine,
N,N'-isophthaloylbispyrrolidine,
N,N'-phthaloylbispyrrolidine,
N,N'-terephthaloylbis-diethylamine,
N,N'-isophthaloylbis-diethylamine,
N,N'-phthaloylbis-diethylamine,
N,N'-terephthaloylbis-dipropylamine,
N,N'-isophthaloylbis-dipropylamine,
N,N'-terephthaloylbis-dibutylamine,
N,N'-isophthaloylbis-dibutylamine,
N,N'-terephthaloylbis-cyclohexyl-methylamine,
N,N'-isophthaloylbiscyclohexyl-methylamine,
N,N'-terephthaloylbis-cyclohexylethylamine,
N,N'-isophthaloylbis-cyclohexylethylamine,
N,N'-terephthaloylbis-cyclohexylpropylamine,
N,N'-terephthaloylbis-(p-methylcyclohexyl)methylamine,
N,N'-isophthaloylbis-(p-methylcyclohexyl)methylamine,
N,N'-terephthaloylbis-dicyclohexylamine,
N,N'-isophthaloylbis-dicyclohexylamine,
N,N'-terephthaloylbis-dibenzylamine,
N,N'-isophthaloylbis-dibenzylamine,
N,N'-terephthaloylbis-dioctylamine,
N,N'-isophthaloylbis-dioctylamine,
N,N'-terephthaloylbis-diethoxypropylamine,
N,N'-terephthaloylbis-di(4-chlorobutylamine), N,N
N,N'-terephthaloylbis-dibenzoylaminoethylamine,
N,N'-isophthaloylbis-dibenzoylaminoethylamine,
N,N'-terephthaloylbis-benzoylaminopropylamine,
N,N'-isophthaloylbis-benzoylaminopropylamine,
N,N'-terephthaloylbis-diacetylaminoethylamine,
N,N'-isophthaloylbis-diacetylaminoethylamine,
N,N'-terephthaloylbis(4-methylpiperidine),
N,N'-terephthaloylbis(3-methylpiperidine),
N,N'-terephthaloylbis(3,5-dimethylpiperidine),
N,N'-terephthaloylbis(2-methylpiperidine),
N,N'-terephthaloylbis(2,6-dimethylpiperidine),
N,N'-isophthaloylbis(4-methylpiperidine),
N,N'-phthaloylbis(4-methylpiperidine),
N,N'-isophthaloylbis(3-methylpiperidine),
N,N'-phthaloylbis(3-methylpiperidine),
N,N'-isophthaloylbis(3,5-dimethylpiperidine),
N,N'-phthaloylbis(3,5-dimethylpiperidine),
N,N'-isophthaloylbis(2-methylpiperidine),
N,N'-phthaloylbis(2-methylpiperidine),
N,N'-isophthaloylbis(2,6-dimethylpiperidine),
N,N'-phthaloylbis(2,6-dimethylpiperidine),
N,N'-terephthaloylbis(4-benzylpiperidine),
N,N'-isophthaloylbis(4-benzylpiperidine),
N,N'-phthaloylbis(4-benzylpiperidine),
N,N'-terephthaloylbis(4-methoxycarbonylpiperidine),
N,N'-isophthaloylbis(4-methoxycarbonylpiperidine),
N,N'-terephthaloylbis(2-methoxycarbonylpiperidine),
N,N'-isophthaloylbis(2-methoxycarbonylpiperidine),
N,N'-phthaloylbis(2-methoxycarbonylpiperidine),
N,N'-terephthaloylbis(4-ethylpiperidine),
N,N'-terephthaloylbis(4-propylpiperidine),
N,N'-terephthaloylbis(4-butylpiperidine),
N,N'-isophthaloylbis(4-ethylpiperidine),
N,N'-isophthaloylbis(4-n-propylpiperidine),
N,N'-isophthaloylbis(4-butylpiperidine),
N,N'-phthaloylbis(4-ethylpiperidine),
N,N'-phthaloylbis(4-propylpiperidine),
N,N'-phthaloylbis(4-butylpiperidine),
N,N'-terephthaloylbis(3-hydroxymethylpiperidine),
N,N'-isophthaloylbis(3-hydroxymethylpiperidine),
N,N'-phthaloylbis(3-hydroxymethylpiperidine),
N,N'-terephthaloylbis(5-ethyl-2-methylpiperidine),
N,N'-isophthaloylbis(5-ethyl-2-methylpiperidine),
N,N'-phthaloylbis(5-ethyl-2-methylpiperidine),
N,N'-terephthaloylbis(N-ethyl-N'-cyclohexylamine),
N,N'-isophthaloylbis(N-ethyl-N'-cyclohexylamine),
N,N'-phthaloylbis(N-ethyl-N'-cyclohexylamine),
N,N'-terephthaloylbis(N-propyl-N'-cyclohexylamine),
N,N'-isophthaloylbis(N-propyl-N'-cyclohexylamine),
N,N'-phthaloylbis(N-propyl-N'-cyclohexylam:ine),
N,N'-terephthaloylbis(N-butyl-N'-cyclohexylamine),
N,N'-isophthaloylbis(N-butyl-N'-cyclohexylamine),
N,N'-phthaloylbis(N-butyl-N'-cyclohexylamine),
N,N'-terephthaloylbis(4-ethyloxymethylpiperidine),
N,N'-isophthaloylbis(4-ethyloxymethylpiperidine),
N,N'-terephthaloylbis(4-ethyloxyethylpiperidine),
N,N'-isophthaloylbis(4-ethyloxyethylpiperidine),
N,N'-terephthaloylbis(2-methoxyethylpiperidine),
N,N'-isophthaloylbis(2-methoxyethylpiperidine),
N,N'-terephthaloylbis(4-methoxyethylpiperidine),
N,N'-isophthaloylbis(4-methoxyethylpiperidine),
N,N'-terephthaloylbis(4-phenylpiperidine),
N,N'-isophthaloylbis(4-phenylpiperidine),
N,N'-phthaloylbis(4-phenylpiperidine),
N,N'-terephthaloylbis(4-phenylpropylpiperidine),
N,N'-isophthaloylbis(4-phenylpropylpiperidine), and
N,N'-phthaloylbis(4-phenylpropylpiperidine).

The piperazine compound having at least two amido groups has the following formula (II):

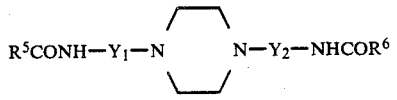

(II)

wherein $R^5$ and $R^6$ each represent an alkyl group, alkyl, cycloalkyl group, aryl group or aralkyl group which may have a substituent, $Y^1$ and $Y^2$ each represent a straight or branched alkylene group having 1 to 18 carbon atoms, and the above piperazine ring may also have one or more substituents.

The above alkyl group is preferably a straight chain or branched alkyl group having 1 to 18 carbon atoms. An example of the cycloalkyl group is cyclohexyl group; examples of the aryl group are phenyl group, tolyl group and xylyl group; and examples of the aralkyl group are benzyl group and phenethyl group.

Examples of a substituent of such alkyl group, alkyl, cycloalkyl group, aryl group or aralkyl group alkyl group, aryl group, halogen, alkoxy group, aryloxy group, aralkyloxy group, acyl group, acyloxy group, alkoxycarbonyl group, carbamoyl group and acylamino group.

As mentioned above, the piperazine ring in the formula (II) may also have one or more substitutents, for example, alkyl group, aryl group, halogen, alkoxy group, aryloxy group, acyl group, acyloxy group, alkoxycarbonyl group, carbamoil group and acylamino group.

Specific examples of the piperazine compound having the formula (II) are as follows:

N,N'-bis(benzoylaminopropyl)piperazine,
N,N'-bis(benzoylaminoethyl)piperazine,
N,N'-bis(benzoylaminobutyl)piperazine,
N,N'-bis(benzoylaminopentyl)piperazine,
N,N'-bisbenzoylaminohexyl)piperazine,
N,N'-bis(benzoylaminooctyl)piperazine,
N,N'-bis(benzoylaminolauryl)piperazine,
N,N'-bis(benzoylaminostearyl)piperazine,
N,N'-bis(p-chlorobenzoylam:inopropyl)piperazine,
N,N'-bis(p-isopropylbenzylaminopropyl)piperazine,
N,N'-bis(p-methylbenzoylaminopropyl)piperazine,
N,N'-bis(m-methylbenzoylaminopropyl)piperazine,
N,N'-bis(o-chlorobenzoylaminopropyl)piperazine,
N,N'-bis(p-chlorobenzoylaminoethyl)piperazine,
N,N'-bis(p-chlorobenzoylaminohexyl)piperazine,
N,N'-bis(p-methylbenzoylaminohexyl)piperazine,
N,N'-bis(o-chlorobenzoylaminohexyl)piperazine,
N,N'-bis(benzoylaminopropyl)piperazine,
N,N'-bis(cyclohexylaminopropyl)piperazine,
N,N'-bis(cyclohexylbutyrylaminopropyl)piperazine,
N,N'-bis(pivaloylaminopropyl)piperazine,
N,N'-bis(stearoylaminopropyl)piperazine,
N,N'-bis(phenylacetylaminopropyl)piperazine,
N,N'-bis(phenethyloylaminoethyl)piperazine,
N,N'-bis(α-naphthoylaminoethyl)piperazine,
N,N'-bis(β-naphthoylaminoethyl)piperazine,
N,N'-bis(α-naphthoylaminopropyl)piperazine,
N,N'-bis(β-naphthoylaminopropyl)piperazine,
N,N'-bis(p-methoxycarbonylbenzoylaminopropyl) piperazine,
N,N'-bis(p-methoxybenzoylaminopropyl)piperazine,
N-benzoylaminopropyl-N'-cyclohexylaminoethylpiperazine,
N-benzoylaminopropyl-N'-benzoylaminobutylpiperazine,
N-(p-chlorobenzoylaminoamyl)-N'-benzoylaminopropylpiperazine,
N-cyclohexyloylaminopropyl-N'-cyclohexyloylaminobutylpiperazine,
N-napthoylaminopropyl-N'-benzoylaminopropylpiperazine,
N-butyloylaminopropyl-N'-benzoylaminopropylpiperazine,
N-lauroylaminopropyl-N'-benzoylaminopropylpiperazine,
N-stearoylaminopropyl-N'-benzoylaminopropylpiperazine,
N-butyroylaminopropyl-N'-cyclohexyloylaminobutylpiperazine,
N-naphthoylaminopropyl-N'-lauroylaminopropylpiperazine,
N-naphthoylaminopropyl-N'-stearoylaminopropylpiperazine.

In the present invention, as the coloring agents for use in at least the thermosensitive coloring layers except the lowermost thermosensitive coloring layer which is adjacent to the support material, such coloring agents are employed that are capable of yielding stable colored images by application of a relatively low amount of thermal energy, which colored images can be readily decolorized by the above mentioned decolorizing agents. Specifically, in the present invention, basic leuco dyes are employed in the thermosensitive coloring layers. As the coloring agents for use in the lowermost first thermosensitive coloring layer, such coloring agents can be employed that are capable of yielding colored images which are hardly decolorized by the above decolorizing agents. Therefore, as such coloring agents, not only leuco dyes, but also other conventional dyes that can be colored by application of thermal energy and other conventional thermosensitive coloring systems can be employed.

The multi-color thermosensitive recording material according to the present invention has the advantages over conventional multi-color thermosensitive recording materials that the whiteness of the background is high and can be maintained over a long period of time, and the multi-colors are obtained with excellent color separation, without deterioration with time.

In the multi-color thermosensitive recording material according to the present invention, when necessary, an intermediate layer can be interposed between each pair of the thermosensitive coloring layer and the decolorizing layer, for instance, in order to prevent the interaction between the thermosensitive coloring layer and the decolorizing layer during storage. Further, a protective layer can be formed on the uppermost thermosensitive coloring layer for protecting the developed images.

As such intermediate layer, a layer comprising a water-soluble resin or latex resin, a layer comprising a thermofusible material and a layer comprising a water-soluble resin or latex resin, a thermofusible material and a filler can be employed. The ingredients in such intermediate layer are preferably colorless or white and have appropriate melting points for thermal coloring.

As the protective layer, for instance, a layer comprising a water-soluble resin, a cross-linking agent for forming a resin in the layer, and a filler pigment, can be employed. To such a protective layer, latexes, ultraviolet-ray-setting resin and electron-beam-setting resin can be added.

As the basic leuco dyes for use in the thermosensitive coloring layers in the present invention, the leuco dyes conventionally employed in the field of thermosensitive recording materials can also employed. They can be used alone or in combination. Examples of such leuco dyes are triphenylmethane-type leuco compounds, fluoran-type leuco compounds, phenothiazine-type leuco compounds, auramine-type leuco compounds and spiropyran-type leuco compounds. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3,6-dimethoxyfluoran,
3-cyclohexylamino-6-chlorofluoran,
3-diethylamino-6-chloro-7-methylfluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran, 3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-dibutylamino-7-(o-fluoroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N-isoamyl-N-ethyl)amino-7-(o-chloroanilino)fluoran,
3-(N-hexyl-N-methyl)amino-7-(o-chloroanilino)fluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2 -hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-dimethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(a-phenylethylamino)fluoran,
3-diethylamino-7-piperidinofluoran,
2-chloro-3-(N-methyltoluidino)-7-(p-n-butylanilino)fluoran,
3-(N-benzyl-N-cyclohexylamino)-5,6-benzo-7-α-naphthylamino-4'-bromofluoran, and
3-diethylamino-6-methyl-7-mesidino-4',5'-benzofluoran.

These leuco dyes can be used alone or in combination.

Examples of preferable basic leuco dyes for use in the first lowermost thermosensitive coloring layer are as follows:

3-diethylamino-7-chlorofluoran,
3-diethylamino-6-methyl-7-chlorofluoran,
3-cychohexylamino-6-chlorofluoran, and
3-diethylaminobenzo[α]fluoran.

Furthermore, in the first thermosensitive coloring layer, acidic leuco dyes, for example, acylated lactones and sultone-type leuco dyes can be contained:

Specific examples of such acidic leuco dyes are as follows:

3,6-diacetyl-2',3',4',5'-tetrachlorofluorescein,
3,6-diacetyl-4,5-dibromo-2,7-dinitrofluorescein,
3,6-diacetyl-2,4,5,7-tetraiodofluorescein,
3,6-dichloroacetyl-4,5-dibromo-2',3',4',5'-tetrachlorofluorescein, and
3,6-diacetyl-2,4,5,7-tetrabromofluorescein.

As the color developers capable of inducing color formation in the above mentioned basic leuco dyes upon application of heat, for example, the following can be employed:

N,N'-diphenylthiourea,
N-p-ethylphenyl-N'-phenylthiourea,
N-p-butylphenyl-N'-phenylthiourea,
N,N'-di(m-chlorophenyl)thiourea,
N,N'-di(p-chlorophenyl)thiourea,
N,N'-di(m-trifluoromethylphenyl)thiourea,
N,N'-di(m-methylphenyl)thiourea,
4,4'-isopropylidenediphenol,
4,4'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2,6-dimethylphenol),
4,4'-isopropylidenebis(2-tert-butylphenol),
4,4'-sec-butylidenediphenol,
4,4'-cychlohexylidenebisphenol,
4,4'-cychlohexylidenebis(2-methylphenol),
4-tert-butylphenol,
4-phenylphenol,
4-hydroxydiphenoxide,
α-naphthol,
β-naphthol,
3,5-xylenol,
thymol,
methyl 4-hydroxybenzoate,
4-hyroxyacetophenone,
novolak-type phenolic resin,
2,2'-thiobis(4,6-dichlorophenol),
catechol,
resorcinol,
hydroquinone,
pyrogallol,
phloroglucine,
phloroglucinocarboxylic acid,
4-tert-octylcatechol,
2,2'-methylenebis(4-chlorophenol),
2,2'-methlenebis(4-methyl-6-tert-butylphenol),
2,2'-dihydroxy-diphenyl,
ethyl p-hydroxybenzoate,
propyl p-hydroxybenzoate,
butyl p-hydroxybenzoate,
benzyl p-hydroxy-benzoate,
p-chlorobenzyl p-hydroxybenzoate,
o-chlorobenzyl p-hydroxybenzoate,
p-methylbenzyl p-hydroxybenzoate,
n-octyl benzoic acid p-hydroxybenzoate,
zinc salicylate,
1-hydroxy-2-naphthoic acid,
2-hydroxy-6-naphthoic acid,
4-hydroxy diphenyl sulfone,
4-hydroxy-4'-chlorodiphenyl sulfone,
bis(4-hydroxyphenyl)sulfide,
4,4'-diphenolsulfone,
4,4'-thiodiphenol,
4,4'-thio-m-cresol,
4,4'-thio-o-cresol, and
4,4'-thiodi(2-isopropylphenol).

In addition to the previously mentioned leuco dye coloring systems, the following coloring systems can also be employed in the first thermosensitive coloring layer:

(1) A thermosensitive coloring system comprising a combination of (a) a long-chain fatty acid iron salt such as iron stearate and iron myristate, and (b) a phenolic compound such as gallic acid and ammonium salicylate.

(2) A thermosensitive coloring system comprising a combination of (a) an organic heavy metal salt such as nickel-, cobalt-, lead-, copper-, iron-, mercury- and silver-salts of acetic acid, stearic acid and palmitic acid and (b) an alkali earth metal sulfide such as calcium sulfide, strontium sulfide and potassium sulfide, or a combination of (a) one of the above organic heavy metal salts and (c) an organic chelating agent such as s-diphenylcarbazide and diphenylcarbazone.

(3) A thermosensitive coloring system comprising a combination of (a) a heavy metal sulfate such as silver sulfate, lead sulfate, mercury sulfate and thorium sulfate, and (b) a sulfur compound such as sodium tetrathionate, sodium thiosulfate and thiourea.

(4) A thermosensitive coloring system comprising a combination of (a) a fatty acid iron salt (II) such as iron stearate and (b) an aromatic polyhydroxy compound such as 3,4-dihydroxytetraphenylmethane.

(5) A thermosensitive coloring system comprising a combination of (a) an organic acid noble metal salt such as silver oxalate and mercury oxalate and (b) an organic polyhydroxy compound such as polyhydroxy alcohol, glycerol and glycol.

(6) A thermosensitive coloring system comprising a combination of (a) an organic acid metal salt such as silver behenate and silver stearate and (b) an aromatic organic reducing agent such as protocatechuic acid, spiro-indane and hydroquinone.

(7) A thermosensitive coloring system comprising a combination of (a) a fatty acid iron salt (II) such as iron pelagonate and iron laurate and (b) a thiosemicarbamide derivative or an isothiosemicarbamide derivative.

(8) A thermosensitive coloring system comprising a combination of (a) an organic acid lead salt such as lead caproate, lead pelargonate and lead behenate and (b) a thiourea derivative such as ethylenethiourea and N-dodecylthiourea.

(9) A thermosensitive coloring system comprising a combination of (a) a higher fatty acid heavy metal salt such as iron stearate and copper stearate and (b) lead dialkyl dithiocarbamate.

(10) A thermosensitive coloring system forming an oxazine dye, for instance, a coloring system comprising a combination of (a) resorcinol and (b) a nitroso compound.

(11) A thermosensitive coloring system forming an azo dye from an aromatic diazonium compound and a coupler.

(12) A thermosensitive coloring system comprising a combination of a formazan compound and a metal salt.

In the present invention, a wide variety of conventional binder agents can be employed for fixing the above-mentioned thermosensitive coloring layers and decolorizing layer to the support material and to the other layers in contact therewith.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin, casein and styrene/maleic acid copolymer salt; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic acid derivative copolymer.

Further in the present invention, auxiliary additive components which are employed in the conventional thermosensitive recording materials, such as fillers, surface active agents and thermofusible materials (or unguents), can be employed in the thermosensitive coloring layers and decolorizing layers.

As the fillers, for example, the following can be employed: inorganic powders of calcium carbonate, silica, zinc oxide, titanium oxide, aluminum hydroxide, zinc hydroxide, barium sulfate, clay, talc and surface-treated calcium and silica; and organic powders of ureaformaldehyde resin, styrene/methacrylic acid copolymer and polystyrene resin.

As the thermofusible materials, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50° C. to 200° C. can be employed.

The thermosensitive recording material according to the present invention can be prepared, for example, by successively applying a thermosensitive coloring layer formation liquid and a decolorizing layer formation liquid to an appropriate support member such as paper, synthetic paper or plastic film, and drying the applied liquids. At the time of coating the thermosensitive coloring layer formation liquids and decolorizing layer formation liquids, care must be taken with respect to the mutual solubilities of the components of the successively coated layers and the peeling of the layers, so as to prevent the mixing of the components of the layer formation liquids. Before coating the next thermosensitive coloring layer formation liquid on the already coated layer, the coated layer can be subjected to calendering for facilitating the perfect coating of the next thermosensitive coloring layer.

It is preferable that the deposition amount of the dye component in the first thermosensitive coloring layer be in the range of 0.3 $g/m^2$ to 1.0 $g/m^2$ and the deposition amount of the decolorizing agent in the decolorizing layer be in the range of 1.0 $g/m^2$ to 10 $g/m^2$. As for the deposition amount of the dye components in the succeeding thermosensitive coloring layers, the greater the deposition amount of the dye components, the better for obtaining higher image density. However, in order to enhance the decolorizing effect of the decolorizing layer and to reduce the cost, the smaller the deposition amount, the better. On balance, it is preferable that the deposition amount of the dye component in the succeeding thermosensitive coloring layers be in the range of 0.2 $g/m^2$ to 0.6 $g/m^2$.

It is preferable that the ratio by weight of the dye component to the color developer for the dye component in each coloring layer be (1:1) to (1:3).

When a protective layer is formed on the uppermost thermosensitive coloring layer, it is preferable that the deposition amount of the protective layer (on dry basis) be in the range of 0.5 $g/m^2$ to 8.0 $g/m^2$.

When an intermediate layer is formed between the decolorizing layer and the thermosensitive coloring layer, it is preferable that the deposition amount of the intermediate layer (on dry basis) be in the range of 0.5 $g/m^2$ to 5.0 $g/m^2$.

In the present invention, in order to form multicolors, the thermosensitive coloring layers can be overlaid from the first (lowermost) to the third (uppermost), for instance, (a) a magenta color layer, a cyan color layer and a yellow color layer, or (b) a magenta color layer, a black color layer and a cyan color layer; from the first (lowermost) to the fourth (uppermost), for instance, (c) a magenta color layer, a cyan color layer, a yellow color layer and a black color layer; from the first (lowermost) to the fifth (uppermost), for instance, (d) a yellow color layer, a magenta color layer, a cyan color layer, a yellow color layer and a black color layer, with the coloring temperatures of those layers set in the previously explained relationship, whereby a variety of colors can be obtained. The above are more examples showing the formation of a variety of colors by the present invention and many different combinations are of course possible within the scope of the present invention.

By referring to the following examples, the present invention will now be explained in detail.

EXAMPLE 1

[Preparation of First Thermosensitive Coloring Layer Formation Liquid]

A dispersion A-1 and a dispersion B-1 were separately components in a ball mill for 24 hours:

Dispersion A-1

| | Parts by Weight |
|---|---|
| 3-diethylamino-7-chlorofluoran | 20 |
| 3-diethylamino-7,8-benzofluoran | 5 |
| 10% aqueous solution of hydroxyethylcellulose | 20 |
| Water | 60 |

Dispersion B-1

| | Parts by Weight |
|---|---|
| Bisphenol S | 10 |
| p-methoxycarbonyloctadecylcarbamoyl benzene | 5 |
| 10% aqueous solution of hydroxyethylcellulose | 15 |
| Silica | 10 |
| Water | 75 |

The above prepared Dispersion A-1 and Dispersion B-1 were mixed well with a ratio by weight of 5:40, so that a first thermosensitive coloring layer formation liquid was prepared.

[Preparation of Intermediate Layer Formation Liquid]

The following components were dispersed in a ball mill for 24 hours, so that Dispersion C-1 was prepared, which served as an intermediate layer formation liquid:

Dispersion C-1

| | Parts by Weight |
|---|---|
| m-xylenebisstearamide | 10 |
| 10% aqueous solution of polyvinyl alcohol | 20 |
| Finely-divided polystyrene particles | 5 |
| Water | 40 |

[Preparation of Decolorizing Layer Formation Liquid]

The following components were dispered in a ball mill for 24 hours, so that Dispersion D-1 was prepared, which served as a decolorizing layer formation liquid:

Dispersion D-1

| | Parts by Weight |
|---|---|
| Terephthalic acid bis-(N—ethylcyclohexylamide) | 20 |
| 10% aqueous solution of polyvinyl alcohol | 20 |
| Water | 60 |

[Preparation of Second Thermosensitive Coloring Layer Formation Liquid]

A dispersion A-2 and a dispersion B-2 were separately prepared by grinding and dispersing the following respective components in a ball mill for 24 hours:

Dispersion A-2

| | Parts by Weight |
|---|---|
| Crystal Violet Lactone | 20 |
| 10% aqueous solution of hydroxyethylcellulose | 20 |
| Water | 60 |

Dispersion B-2

| | Parts by Weight |
|---|---|
| 3,3'-dichlorophenylthiourea | 10 |
| Calcium carbonate | 10 |
| 10% aqueous solution of polyvinyl alcohol | 20 |
| Water | 60 |

The above prepared Dispersion A-2 and Dispersion B-2 were mixed well with a ratio by weight of 1:4, so that a second thermosensitive coloring layer formation liquid was prepared.

[Preparation of Third Thermosensitive Coloring Layer Formation Liquid]

A dispersion A-3 and the dispersion B-2 (employed in the preparation of the second thermosensitive coloring layer formation liquid) were separately prepared by grinding and dispersing the following respective components in a ball mill for 24 hours:

Dispersion A-3

| | Parts by Weight |
|---|---|
| 3,6-dimethoxyfluoran | 20 |

-continued

| | Parts by Weight |
|---|---|
| 10% aqueous solution of hydroxy-ethylcellulose | 20 |
| Water | 60 |

Dispersion B-2

| | Parts by Weight |
|---|---|
| 3,3'-dichlorophenylthiourea | 10 |
| Calcium carbonate | 10 |
| 10% aqueous solution of polyvinyl alcohol | 20 |
| Water | 60 |

The above prepared Dispersion A-3 and Dispersion B-2 were mixed well with a ratio by weight of 1:3, so that a third thermosensitive coloring layer formation liquid was prepared.

The first thermosensitive coloring layer formation liquid was first coated on a sheet of commercially available high quality paper with a coloring dye component deposition of 0.4 g/m$^2$ (on dry basis), so that a first thermosensitive coloring layer was formed on the high quality paper.

The intermediate layer formation liquid was then coated on the first thermosensitive coloring layer with a deposition of 3 g/m$^2$ (on dry basis), so that a first intermediate layer was formed on the first thermosensitive coloring layer.

The decolorizing layer formation liquid was then coated on the first intermediate layer with a deposition of 2 g/m$^2$ (on dry basis), so that a first decolorizing layer was formed on the first intermediate layer.

The intermediate layer formation liquid was again coated on the first decolorizing layer with a deposition of 2 g/m$^2$ (on dry basis), so that a second intermediate layer was formed on the first decolorizing layer.

The second thermosensitive coloring layer formation liquid was then coated on the second intermediate layer with a coloring dye component deposition of 0.4 g/m$^2$ (on dry basis), so that a second thermosensitive coloring layer was formed on the second intermediate layer.

The intermediate layer formation liquid was further coated on the second thermosensitive coloring layer with a deposition of 2 g/m$^2$ (on dry basis), so that a third intermediate layer was formed on the second thermosensitive coloring layer.

The decolorizing layer formation liquid was then coated on the third intermediate layer with a deposition of 3 g/m$^2$ (on dry basis), so that a second decolorizing layer was formed on the third decolorizing layer.

The intermediate layer formation liquid was again coated on the second decolorizing layer with a deposition of 2 g/m$^2$ (on dry basis), so that a third intermediate layer was formed on the second decolorizing layer.

The third thermosensitive coloring layer formation liquid was then coated on the third intermediate layer with a coloring dye component deposition of 0.4 g/m$^2$ (on dry basis), so that a third thermosensitive coloring layer was formed on the third intermediate layer.

Finally the protective layer formation liquid was coated on the third thermosensitive coloring layer with a solid component deposition of 3.5 g/m$^2$ (on dry basis), so that a multi-color thermosensitive recording material was prepared.

This multi-color thermosensitive recording material was subjected to calendering so as to make the surface of the thermosensitive recording material smooth, whereby a multi-color thermosensitive recording material No. 1 according to the present invention was prepared.

The multi-color thermosensitive recording material No. 1 according to the present invention was subjected to a thermal printing test by use of a thermal recording apparatus including a thermal head, with application of 0.6 mJ/dot of thermal printing energy to the recording material for coloring the third thermosensitive coloring layer, 1.2 mJ/dot for coloring the second thermosensitive coloring layer, and 3.0 mJ/dot for coloring the first thermosensitive coloring layer.

As a result, a yellow image, a blue image and a magenta image were respectively obtained with high clearness in the third, second and first thermosensitive coloring layers. These images were stable in quality and did not deteriorate with time even if they were allowed to stand at room temperature for several months.

Further, the images were covered with a wrapping film of polyvinyl chloride with application of a pressure of 250 g/cm$^2$ for one day. The result was that there were observed no changes in the image areas and the background.

EXAMPLE 2

Example 1 was repeated except that the formulation of the second thermosensitive coloring layer formation liquid and the formulation of the third thermosensitive coloring layer formation liquid were respectively changed to the following, whereby a multi-color thermosensitive recording material No. 2 according to the present invention was prepared.

[Preparation of Second Thermosensitive Coloring Layer Formation Liquid]

A dispersion A-2' and a dispersion B-2 were separately prepared by grinding and dispersing the following respective components in a ball mill for 24 hours:

Dispersion A-2'

| | Parts by Weight |
|---|---|
| 3-dibutylamino-7-(o-chloroanilino) fluoran | 20 |
| 10% aqueous solution of hydroxy-ethylcellulose | 20 |
| Water | 60 |

Dispersion B-2

| | Parts by Weight |
|---|---|
| 3,3'-dichlorophenylthiourea | 10 |
| Calcium carbonate | 10 |
| 10% aqueous solution of polyvinyl alcohol | 20 |
| Water | 60 |

The above prepared Dispersion A-2' and Dispersion B-2 were mixed well with a ratio by weight of 1:4, so that a second thermosensitive coloring layer formation liquid was prepared.

[Preparation of Third Thermosensitive Coloring Layer Formation Liquid]

A dispersion A-3′ and the dispersion B-2 (employed in the preparation of the second thermosensitive coloring layer formation liquid) were separately prepared by grinding and dispersing the following respective components in a ball mill for 24 hours:

Dispersion A-3′

| | Parts by Weight |
|---|---|
| Crystal violet lactone | 20 |
| 10% aqueous solution of hydroxyethylcellulose | 20 |
| Water | 60 |

Dispersion B-2

| | Parts by Weight |
|---|---|
| 3,3′-dichlorophenylthiourea | 10 |
| Calcium carbonate | 10 |
| 10% aqueous solution of polyvinyl alcohol | 20 |
| Water | 60 |

The above prepared Dispersion A-3′ and Dispersion B-2 were mixed well with a ratio by weight of 1:3, so that a third thermosensitive coloring layer formation liquid was prepared.

The multi-color thermosensitive recording material No. 2 according to the present invention was subjected to the same thermal printing test as was done in Example 1 by use of the same thermal recording apparatus.

As a result, a blue image, a black image and a magenta image were respectively obtained with high clearness in the third, second and first thermosensitive coloring layers.

These images were stable in quality and did not deteriorate with time even if they were allowed to stand at room temperature for several months.

Further, the images were covered in the same manner as in Example 1. The result was that there were observed no changes in the image areas and the background.

EXAMPLE 3

Example 1 was repeated except that the three intermediate layers were eliminated, whereby a multi-color thermosensitive recording material No. 3 according to the present invention was prepared.

The multi-color thermosensitive recording material No. 3 according to the present invention was subjected to the same thermal printing test as was done in Example 1. As a result, a yellow image, a blue image and a magenta image were respectively obtained in the third, second and first thermosensitive coloring layers. Although the image densities of those images were slightly lower as compared with those obtained in Example 1 and Example 2, the images were clear and stable in quality to the same extent as in the images obtained in Examples 1 and 2.

COMPARATIVE EXAMPLE

Example 1 was repeated except the three intermediate layers and the two decolorizing layers were eliminated, whereby a comparative multi-color thermosensitive recording material was prepared.

The thus prepared comparative multi-color thermosensitive recording material was subjected to the same thermal printing test as was done in Example 1. As a result, a clear yellow image was obtained at application of 0.6 mJ/dot of printing thermal energy. However, when 1.2 mJ/dot and 3.0 mJ/dot of thermal printing energies were applied to the recording material, the obtained images had a mixed blackish color.

What is claimed is:

1. A multi-color thermosensitive recording material comprising a support material, at least threee thermosensitive coloring layers successively overlaid thereon, each coloring layer being capable of yielding a different color by application of a different quantity of thermal energy thereto, the required energy increasing toward the support and decolorizing intermediate layers interposed between said thermosensitive coloring layers, and wherein at least the thermosensitive coloring layers except the thermosensitive coloring layer adjacent to said support material each comprise a basic leuco dye and a color developer capable of inducing color formation in said leuco dye upon application of thermal energy at a predetermined temperature, and each decolorizing intermediate layer comprises a decolorizing agent which is capable of decolorizing the color developed in the thermonsensitive coloring layer overlaid on the decolorizing intermediate layer when heated to a higher temperature than the predetermined coloring temperature for the thermosensitive coloring layer, said decolorizing agent being selected from the group consisting of:

(a) a N,N′-distributed aromatic diamide compound having the formula (I):

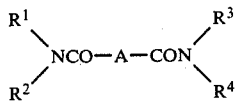

(I)

wherein $R^1$, $R^2$, $R^3$ and $R^4$ each represent an alkyl group, cycloalkyl group, aryl group or aralkyl group which may have a substituent selected from the group consisting of alkyl group, aryl group, alkoxy group, acyl group, halogen, acylamino group, alkoxycarbonyl group, carbamoyl group, aryloxy group and arakyloxy group, or the combination of $R^1$ and $R^2$ and the combination of $R^3$ and $R^4$ each from a ring structure with the terminals of the group in each combination being bonded to each other, and A represents an aromatic group; and (b) a piperazine compound having at leat two amido groups having formula (II):

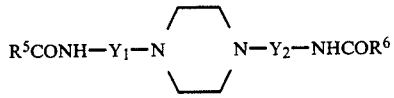

(II)

wherein $R^5$ and $R^6$ each represent an alkyl group, cycloalkyl group, aryl group or aralkyl group which is unsubstituted or substituted by a substituent selected from the group consisting of alkyl group, aryl group, halogen, alkoxy group, aryloxy group, aralkyloxy group, acyl group, acyloxy group, alkoxycarbonyl group, carbamoyl group and acylamino group, $Y^1$ and $Y^2$ each represent a straight or branched alkylene group having 1 to 18carbon atoms, said piperazine ring being unsubstituted or substituted by a group consisting of an alkyl group, aryl group, halogen, alkoxy group, aryloxy group, aralkyloxy group, acyl group, acyloxy group, alkoxycarbonyl group, carbamoyl group and acylamino group.

2. The multi-color thermosensitive recording material as recited in claim 1, wherein each alkyl group represented by $R^1$, $R^2$, $R^3$ and $R^4$ has 1 to 18 carbon atoms.

3. The multi-color thermosensitive recording material as recited in claim 1, wherein the aromatic group represented by A is selected from the group consisting of phenylene, tolylene and xylylene which is unsubstituted or substituted by a substituent selected from the group consisting of halogen, acylamino group, alkoxycarbonyl group, carbamoyl, aryloxy group and aralkyloxy group.

4. The multi-color thermosensitive recording material as recited in claim 1, further comprising an intermediate layer interposed between each said decolorizing layer and said thermosensitive coloring layer located adjacent thereto for preventing the interaction between said two layers during storage of said recording material.

5. The multi-color thermosensitive recording material as recited in claim 4, wherein the deposition amount of said itnermediate layer on a dry basis is in the range of 0.5–5.0 g/m$^2$.

6. The multi-color thermosensitive recording material as recited in claim 1, further comprising a protective layer formed on the top of said successively overlaid thermosensitive coloring layers.

7. The multi-color thermosensitive recording material as recited in claim 6, wherein the deposition amount of the protective layer on a dry basis is in the range of 0.5–8.0 g/m$^2$.

8. The multi-color thermosensitive recording material as recited in claim 1, wherein said basic leuco dye is selected from the group consisting of triphenylmethane-type leuco compounds, fluoran-type leuco compounds, phenothiazine-type leuco compounds, auramine-type leuco compounds and spiropyran-type leuco compounds.

9. The multi-color thermosensitive recording material as recited in claim 1, wherein said thermosensitive coloring layer adjacent to said support material comprises an acidic leuco dye selected from the group consisting of:

3,6-diacetyl-2', 3',4', 5'-tetrachlorofluoroescein,
3,6-diacetyl -4,5-dibromo-2,7-dinitrofluorescein,
3,6-diacetyl-2,4,5,7-tetraiodofluorescein,
3,6-dichloroacetyl-4,5-dibromo-2', 3', 4', 5'-tetrachlorofluorescein, and
3,6-diacetyl-2,4,5,7-tetrabromofluorescein.

10. The multi-color thermosensitive recording material as recited in claim 1, wherein said thermosensitive coloring layer adjacent to said support material comprises a basic leuco dye selected from the group consisting of:

3-diethylamino-7-chlorofluoran,
3-diethylamino-6-methyl-7-chlorofluoran,
3-cychohexylamino-6-chlorofluoran, and
3-diethylaminobenzo[α]fluoran.

11. The multi-color thermosensitive recording material as recited in claim 1, wherein said N,N'-disubstituted aromatic diamide compound having the formula (I) is selected from the group consisting of:

N,N'-terephthaloylbispiperidine,
N,N'-isophthaloylbispiperidine,
N,N'-phthaloylbisperidine,
N,N'-terephthaloylbismorpholine,
N,N'-isophthaloylbismorpholine,
N,N'-phthaloylbismorpholine,
N,N'-terephthaloylbis-4-methylpiperazine,
N,N'-isophthaloylbis-4-methylpiperazine,
N,N'-phthaloylbis-4-methylpiperazine,
N,N'-terephthaloylbis-4-phenylpiperazine,
N,N'-isophthaloylbis-4-phenylpiperazine,
N,N'-phthaloylbis-4-phenylpiperazine,
N,N'-terephthaloylbis-4-propylpiperazine,
N,N'-isophthaloylbis-4-propylpiperazine,
N,N'-phthaloyl-4-propylpiperazine,
N,N'-terephthaloylbiscaprolactam,
N,N'-isophthaloylbiscaprolactam,
N,N'-phthaloylbiscaprolactam,
N,N'-terephthaloylbis-3-chlorocaprolactam,
N,N'-isophthaloylbis-3-chlorocaprolactam,
N,N'-phthaloylbis-3-chlorocaprolactam,
N,N'-terephthaloylbisvalerolactam,
N,N'-isophthaloylbisvalerolactam,
N,N'-phthaloylbisvalerolactam,
N,N'-terephthaloylbispyrrolidine,
N,N'-isophthaloylbispyrrolidine,
N,N'-phthaloylbispyrrolidine,
N,N'-terephthaloylbis-diethylamine,
N,N'-isophthaloylbis-diethylamine,
N,N'-phthaloylbis-diethylamine,
N,N'-terephthaloylbis-dipropylamine,
N,N'-isophthaloylbis-dipropylamine,
N,N'-terephthaloylbis-dibutylamine,
N,N'-isophthaloylbis-dibutylamine,
N,N'-terephthaloylbis-cyclohexyl-methylamine,
N,N'-isophthaloylbiscyclohexyl-methylamine,
N,N'-terephthaloylbis-cyclohexylethylamine,
N,N'-isophthaloylbis-cyclohexylethylamine,
N,N'-terephthaloylbis-cyclohexylpropylamine,
N,N'-terephthaloylbis-(p-methylcyclohexyl)methylamine,
N,N'-isophthaloylbis-(p-methylcyclohexyl)methylamine,
N,N'-terephthaloylbis-dicyclohexylamine,
N,N'-isophthaloylbis-dicyclohexylamine,
N,N'-terephthaloylbis-dibenzylamine,
N,N'-isophthaloylbis-dibenzylamine,
N,N'-terephthaloylbis-dioctylamine,
N,N'-isophthaloylbis-dioctylamine,
N,N'-terephthaloylbis-diethoxypropylamine,
N,N'-terephthaloylbis-di(4-chlorobutylamine),
N,N'-terephthaloylbis-dibenzoylaminoethylamine,
N,N'-isophthaloylbis-dibenzoylaminoethylamine,
N,N'-terephthaloylbis-benzoylaminopropylamine,
N,N'-isophthaloylbis-benzoylaminopropylamine,
N,N'-terephthaloylbis-diacetylaminoethylamine,
N,N'-isophthaloylbis-diacetylaminoethylamine,
N,N'-terephthaloylbis(4-methylpiperidine),
N,N'-terephthaloylbis(3-methylpiperidine),
N,N'-terephthaloylbis(3,5-dimethylpiperidine),
N,N'-terephthaloylbis(2-methylpiperidine),
N,N'-terephthaloylbis(2,6-dimethylpiperidine),
N,N'-isophthaloylbis(4-methylpiperidine),
N,N'-phthaloylbis(4-methylpiperidine), N,N'-isophthaloylbis(3-methylpiperidine),
N,N'-phthaloylbis(3-methylpiperidine),
N,N'-isophthaloylbis(3,5-dimethylpiperidine),
N,N'-phthaloylbis(3,5-dimethylpiperidine),
N,N'-isophthaloylbis(2-methylpiperidine),
N,N'-phthaloylbis(2-methylpiperidine),
N,N'-isophthaloylbis(2,6-dimethylpiperidine),
N,N'-phthaloylbis(2,6-dimethylpiperidine),
N,N'-terephthaloylbis(4-benzylpiperidine),
N,N'-isophthaloylbis(4-benzylpiperidine),
N,N'-phthaloylbis(4-benzylpiperidine),
N,N'-terephthaloylbis(4-methoxycarbonylpiperidine),
N,N'-isophthaloylbis(4-methoxycarbonylpiperidine),
N,N'-terephthaloylbis(2-methoxycarbonylpiperidine),
N,N'-isophthaloylbis(2-methoxycarbonylpiperidine),
N,N'-phthaloylbis(2-methoxycarbonylpiperidine),
N,N'-terephthaloylbis(4-ethylpiperidine),
N,N'-terephthaloylbis(4-propylpiperidine),
N,N'-terephthaloylbis(4-butylpiperidine),
N,N'-isophthaloylbis(4-ethylpiperidine),
N,N'-isophthaloylbis(4-n-propylpiperidine),
N,N'-isophthaloylbis(4-butylpiperidine),
N,N'-phthaloylbis(4-ethylpiperidine),
N,N'-phthaloylbis(4-propylpiperidine),
N,N'-phthaloylbis(4-butylpiperidine),
N,N'-terephthaloylbis(3-hydroxymethylpiperidine),
N,N'-isophthaloylbis(3-hydroxymethylpiperidine),
N,N'-phthaloylbis(3-hydroxymethylpiperidine),
N,N'-terephthaloylbis(5-ethyl-2-methylpiperidine),
N,N'-isophthaloylbis(5-ethyl-2-methylpiperidine),
N,N'-phthaloylbis(5-ethyl-2-methylpiperidine),
N,N'-terephthaloylbis(N-ethyl-N'-cyclohexylamine),
N,N'-isophthaloylbis(N-ethyl-N'-cyclohexylamine),
N,N'-phthaloylbis(N-ethyl-N'-cyclohexylamine),
N,N'-terephthaloylbis(N-propyl-N'-cyclohexylamine),
N,N'-isophthaloylbis(N-propyl-N'-cyclohexylamine),
N,N'-phthaloylbis(N-propyl-N'-cyclohexylamine),
N,N'-terephthaloylbis(N-butyl-N'-cyclohexylamine),
N,N'-isophthaloylbis(N-butyl-N'-cyclohexylamine),
N,N'-phthaloylbis(N-butyl-N'-cyclohexylamine),
N,N'-terephthaloylbis(4-ethyloxymethylpiperidine),
N,N'-isophthaloylbis(4-ethyloxymethylpiperidine),
N,N'-terephthaloylbis(4-ethyloxyethylpiperidine),
N,N'-isophthaloylbis(4-ethyloxyethylpiperidine),
N,N'-terephthaloylbis(2-methoxyethylpiperidine),
N,N'-isophthaloylbis(2-methoxyethylpiperidine),
N,N'-terephthaloylbis(4-methoxyethylpiperidine),
N,N'-isophthaloylbis(4-methoxyethylpiperidine),
N,N'-terephthaloylbis(4-phenylpiperidine),
N,N'-isophthaloylbis(4-phenylpiperidine),
N,N'-phthaloylbis(4-phenylpiperidine),
N,N'-terephthaloylbis(4-phenylpropylpiperidine),
N,N'-isophthaloylbis(4-phenylpropylpiperidine), and
N,N'-phthaloylbis(4-phenylpropylpiperidine).

12. The multi-color thermosensitive recording material as recited in claim 1, wherein said piperazine compound having at least two amido groups having the formula (II) is selected from the group consisting of:
N,N'-bis(benzoylaminopropyl)piperazine,
N,N'-bis(benzoylaminoethyl)piperazine,
N,N'-bis(benzoylaminobutyl)piperazine,
N,N'-bis(benzoylaminopentyl)piperazine,
N,N'-bis(benzoylaminohexyl)piperazine,
N,N'-bis(benzoylaminooctyl)piperazine,
N,N'-bis(benzoylaminolauryl)piperazine,
N,N'-bis(benzoylaminostearyl)piperazine,
N,N'-bis(p-chlorobenzoylaminopropyl)piperazine,
N,N'-bis(p-isopropylbenzylaminopropyl)piperazine,
N,N'-bis(p-methylbenzoylaminopropyl)piperazine,
N,N'-bis(m-methylbenzoylaminopropyl)piperazine,
N,N'-bis(o-chlorobenzoylaminopropyl)piperazine,
N,N'-bis(p-chlorobenzoylaminoethyl)piperazine,
N,N'-bis(p-chlorobenzoylaminohexyl)piperazine,
N,N'-bis(p-methylbenzoylaminohexyl)piperazine,
N,N'-bis(o-chlorobenzoylaminohexyl)piperazine,
N,N'-bis(benzoylaminopropyl)piperazine,
N,N'-bis(cyclohexylaminopropyl)piperazine,
N,N'-bis(cyclohexylbutyrylaminopropyl)piperazine,
N,N'-bis(pivaloylaminopropyl)piperazine,
N,N'-bis(stearoylaminopropyl)piperazine,
N,N'-bis(phenylacetylaminopropyl)piperazine,
N,N'-bis(phenethyloylaminoethyl)piperazine,
N,N'-bis($\alpha$-naphthoylaminoethyl)piperazine,
N,N'-bis($\beta$-naphthoylaminoethyl)piperazine,
N,N -bis($\alpha$-naphthoylaminopropyl)piperazine,
N,N'-bis($\beta$-naphthoylaminopropyl)piperazine,
N,N'-bis(p-methoxycarbonylbenzoylaminopropyl) piperazine,
N,N'-bis(p-methoxybenzoylaminopropyl)piperazine,
N-benzoylaminopropyl-N'-cyclohexylaminoethylpiperazine,
N-benzoylaminopropyl-N'-benzoylaminobutylpiperazine,
N-(p-chlorobenzoylaminoamyl)-N'-benzoylaminopropylpiperazine,
N-cyclohexyloylaminopropyl-N'-cyclohexyloylaminobutylpiperazine,
N-napthoylaminopropyl-N'-benzoylaminopropylpiperazine,
N-butyloylaminopropyl-N'-benzoylaminopropylpiperazine,
N-lauroylaminopropyl-N'-benzoylaminopropylpiperazine,
N-stearoylaminopropyl-N'-benzoylaminopropylpiperazine,
N-butyroylaminopropyl-N'-cyclohexyloylaminobutylpiperazine,
N-naphthoylaminopropyl-N'-lauroylaminopropylpiperazine,
N-naphthoylaminopropyl-N'-stearoylaminopropylpiperazine.

13. The multi-color thermosensitive recording material as recited in claim 1, wherein the amount of dye component in the first thermosensitive coloring layer is in the range of 0.3–1.0 g/m$^2$, and the amount of decolorizing agent deposited in the decolorizing layer is in the range of 1.0–10 g/m$^2$.

14. The multi-color thermosensitive recording material as recited in claim 1, wherein the amount of dye component in the thermosensitive coloring layers, other than the first such layer, is in the range of 0.2–0.6 g/m$^2$.

15. The multi-color thermosensitive recording material as recited in claim 1, wherein the ratio by weight of the dye component to the color developer for the dye component in each coloring layer is about 1:1 to 1:3.

16. A multi-color thermosensitive recording material comprising a support material, at least three thermosensitive coloring layers successively overlaid thereon, each coloring layer being capable of yielding a different color by application of a different quantity of thermal energy thereto, the required energy increasing toward the support, and decolorizing intermediate layes interposed between said thermosensitive coloring layers, and wherein at least the thermosensitive coloring layers except the thermosensitive coloring layer adjacent to said support material each comprise a basic eluco dye and a color developer capable of inducing color formation in said leuco dye upon application of thermal energy at a predetermined temperature, and each decolorizing intermediate layer comprises a decolorizing agent which is capable of decolorizing the color developed in the thermosensitive coloring layer overlaid on the decolorizing intermediate layer when heated to a higher temperature than the predetermined coloring temperature for the thermosensitive coloring layer, said decolorizing agent being selected from the group consisting of a:

(a) a N,N'-disubstituted aromatic diamide compound having the formula (I):

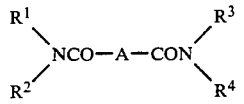

(I)

wherein $R^1$, $R^2$, $R^3$ and $R^4$ each represent an alkyl group, cycloalkyl group, aryl group or aralkyl group which is unsubstituted or substituted by a group selected from the group consisting of alkyl group, aryl group, alkoxy group, acyl group, halogen, acylamino group, alkoxycarbonyl group, carbamoyl group, aryloxy group and aralkyloxy group, or the combination of $R^1$ and $R^2$ and the combination of $R^3$ and $R^4$ each form a ring structure with the terminals of the groups in each combination being bonded to each other, and A represents an aromatic group; and (b) a piperazine compound having at least two amido groups having formula (II):

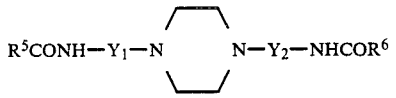

(II)

wherein $R^5$ and $R^6$ each represent an alkyl group, cycloalkyl group, aryl group or aralkyl group which is unsubstituted or substituted by a group selected from the group consisting of alkyl group, aryl group, halogen, alkoxy group, aryloxy group, aralkyloxy group, acyl group, acyloxy group, alkoxycarbonyl group, carbamoyl group and acylamino group, $Y^1$ and $Y^2$ each represent a straight or branched alkylene group having 1 to 18 carbon atoms, and said piperazine ring is unsubstituted or substituted by a group selected from the group consisting of an alkyl group, aryl group, halogen, alkoxy group, aryloxy group, aralkyloxy group, acyl group, acyloxy group, alkoxycarbonyl group, carbamoyl group and acylamino group, and wherein said first thermosensitive layer consists essentially of coloring agents which are capable of yielding images which remain substantially decolorized by the above decolorizing agent.

17. A multi-color thermosensitive recording material comprising a support material, at least three thermosensitive coloring layers successively overlaid thereon, each coloring layer being capable of yielding a different color by application of a different quantity of thermal energy thereto, the required energy increasing toward the support, and decolorizing intermediate layers interposed between said thermosensitive coloring layers, and wherein at least the thermosensitive coloring layers except the thermosensitive coloring layer adjacent to said support material each comprise a basic leuco dye and a color developer capable of inducing color formation in said leuco due upon application of thermal energy at a predetermined temperature, and each decolorizing intermediate layer comprises a decolorizing agent which is capable of decolorizing the color developed in the thermosensitive coloring layer overlaid on the decolorizing intermediate layer when heated to a higher temperature than the predetermined coloring temperature for the thermosensitive coloring layer, said decolorizing agent being selected from the group consisting of:

(a) A N,N'-disubstituted aromatic diamide compound having the formula (I):

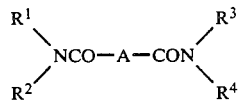

(I)

wherein $R^1$, $R^2$, $R^3$ and $R^4$ each represent an alkyl group, cycloalkyl group, aryl group or aralkyl group which is unsubstituted or substituted by a group selected from the group consisting of alkyl group, aryl group alkoxy group, acyl group, halogen, acylamino group, alkoxycarbonyl group, carbamoyl group, aryloxy group and araylkylloxy group, or the combination of $R^1$ and $R^2$ and the combination of $R^3$ and $R^4$ each form a ring structure with the terminals of the groups in each combination being bonded to each other, and A represents an aromatic group; and (b) a piperazine compound having at least two amido groups having formula (II):

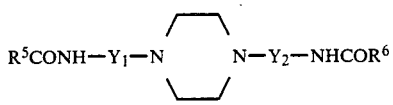

(II)

wherein $R^5$ and $R^6$ each represent an alkyl group, cycloalkyl group, aryl group or aralkyl group which is unsubstituted or aubstituted by a group selected from the group consisting of alkyl group, aryl group, halogen, alkoxy group, aryloxy group, aralkyloxy group, acyl group, acyloxy group, alkoxycarbonyl group, carbamoyl group and acylamino group, $Y^1$ and $Y^2$ each represent a straight or branched alkylene group having 1 to 18 carbon atoms, and aid piperazine ring is unsubstituted or substituted by a group selected from the group consisting of alkyl group, aryl group, halogen, alkoxy group, aryloxy group, aralkyloxy group, acyl group, acyloxy group, alkoxycarbonyl group, carbamoyl group and acylamino group, and wherein said first thermosensitive layer consists essentially of (1) a basic eluco dye selected from the group consisting of 3-diethylamino-7-chlorofluoran, 3-diethylamino-6-methyl-7-chlorofuran, 3-cyclohexylamino-6-chlorofluoran, and 3-diethylaminobenzo[α] fluoran; (2) an acidic leuco dye selected from the group consisting of 3,6-diacetyl-2',3',4',5'-tetrachlorofluorescein; 3,6-diacetyl-4,5-dibromo-2,7-dinitrofluorescein; 3,6-diacetyl-2,4,5,7-tetraiodofluorescein; 3,6-dichloroacetyl-4,5-dibromo-2',3',4',5'-tetrachlorofluorescein; and 3,6-diacetyl-2,4,5,7-tetrabromofluorescein; and (3) a coloring system selected from the group consisting of:

(1) a thermosensitive coloring system comprising a combination of (a) a long-chain fatty acid iron salt selected from the group consisting of iron stearate and iron myristate, and (b) a phenolic compound selected from the group consisting of gallic acid and ammonium salicylate;

(2) a thermosensitive coloring system comprising a combination of (a) an organic heavy metal selected from the group consisting of nickel-, cobalt-, lead-, copper-, iron-, mercury and silver-salts of acetic acid, stearic acid and palmitic acid and (b) an alkali earth metal sulfide selected from the group consisting calcium sulfide, strontium sulfide and potassium sulfide, or a combination of (a) one of the above organic heavy metal salts and (c) an organic chelating agent selected from the group consisting of s-diphenylcarbazide and diphenylcarbazone;

(3) a thermosensitive coloring system comprising a combination of (a) a heavy metal sulfate selected from the group consisting of silver sulfate, lead suflate, mercury sulfate and thorium sulfate, and (b) a sulfur compound selected from the group consisting of sodium tetrathionate, sodium thiosulfate and thiourea;

(4) a thermosensitive coloring system comprising a combination of (a) iron strearate and (b) 3,4-dihydroxytetraphenylmethane;

(5) a thermosensitive coloring system comprising a combination of (a) an organic acid noble metal salt selected from the group consisting of silver oxalate and mercury oxalate and (b) an organic polyhydroxy compound selected from the group consisting of pooyhydroxy alcohol, glycerol and glycol;

(6) a thermosensitive coloring system comprising a combination of (a) an organic acid metal salt selected from the group consisting of silver behenate and silver stearate and (b) an aromatic organic reducing agent selected from the group consisting of protocatechuic acid, spiro-indane and hydroquinone;

(7) a thermosensitive coloring system comprising a combination of (a) a fatty acid iron salt, (II) selected from he group consisting of iron pelogonate and iron laurate and (b) a thiosemicarbamide derivative or an isothiosemicarbamide derivative;

(8) a thermosensitive coloring system comprising a combination of (a) an organic acid lead salt selected from the group consisting of lead caproate, lead pelargonate and lead behenate and (b) a thiourea derivative selected from the group consisting of ethylenethiourea and N-dodecylthiourea;

(9) a thermosensitive coloring system comprising a combination of (a) a higher fatty acid heavy metal salt selected from the group consisting of iron stearate and copper stearate and (b) lead dialkyldithiocarbamate;

(10) a thermosensitive coloring system comprising a combination of (a) resorcinol and (b) a nitroso compound, thereby forming an oxazine dye;

(11) a thermosensitive coloring system forming an azo dye from an aromatic diazonium compound and a coupling agent; and (b 12) a thermosensitive coloring system comprising a combination of a formazan compound and a metal salt.

* * * * *